United States Patent [19]

Aoun

[11] Patent Number: 4,527,919

[45] Date of Patent: Jul. 9, 1985

[54] METHOD FOR THE COMPOSITION OF TEXTS IN ARABIC LETTERS AND COMPOSITION DEVICE

[75] Inventor: Joseph Aoun, Beirut, Lebanon

[73] Assignee: Lettera Arabica S.a.r.l., Beirut, Lebanon

[21] Appl. No.: 560,261

[22] Filed: Dec. 12, 1983

Related U.S. Application Data

[63] Continuation of Ser. No. 490,205, May 2, 1983, abandoned, which is a continuation of Ser. No. 389,896, Jun. 18, 1982, abandoned, which is a continuation of Ser. No. 199,300, Oct. 21, 1980, abandoned, which is a continuation of Ser. No. 3,949, Jan. 16, 1979, abandoned.

[30] Foreign Application Priority Data

| | | | |
|---|---|---|---|
| Feb. 7, 1978 | [LB] | Lebanon | 562 |
| May 15, 1978 | [LB] | Lebanon | 571 |
| Nov. 1, 1978 | [LB] | Lebanon | 832 |

[51] Int. Cl.[3] ..... B41J 5/00

[52] U.S. Cl. ..... 400/111; 178/30

[58] Field of Search ..... 400/111; 178/30

[56] References Cited

U.S. PATENT DOCUMENTS

| | | | |
|---|---|---|---|
| 2,940,575 | 6/1960 | Khalil | 197/1 |
| 3,513,968 | 5/1970 | Hanson | 400/111 X |
| 3,938,099 | 2/1976 | Hyder | 400/111 X |
| 3,998,310 | 12/1976 | Chaudhry | 400/111 |
| 4,137,425 | 1/1979 | Ferroglio et al. | 400/111 X |
| 4,145,570 | 3/1979 | Diab | 400/111 X |
| 4,150,902 | 4/1979 | Brescia | 400/111 X |

FOREIGN PATENT DOCUMENTS

| | | | |
|---|---|---|---|
| 2018868 | 11/1971 | Fed. Rep. of Germany . | |
| 2446646 | 4/1975 | Fed. Rep. of Germany . | |
| 2444326 | 5/1975 | Fed. Rep. of Germany . | |
| 2517555 | 11/1976 | Fed. Rep. of Germany . | |
| 2749012 | 5/1978 | Fed. Rep. of Germany . | |
| 7328622 | 3/1975 | France | 400/111 |
| 2249773 | 5/1975 | France . | |
| 2369937 | 6/1978 | France . | |
| 125224 | of 0000 | Pakistan . | |
| 668418 | 3/1952 | United Kingdom . | |
| 1162180 | 8/1969 | United Kingdom . | |
| 1172553 | 12/1969 | United Kingdom . | |
| 1283575 | 2/1972 | United Kingdom . | |
| 1461413 | 1/1977 | United Kingdom . | |

OTHER PUBLICATIONS

"Motorola Semiconductors, MEK6800D2", published by Motorola, Inc., 1976, 2 pages.

Manual, "M6800 Microcomputer System Design Data", published by Motorola, Inc., 1976, pp. 1-165.

IBM Technical Disclosure Bulletin, vol. 17, No. 8, Jan. 1975, A. Arellano and H. Marcar, "Word Generation System for Typist".

M. Hashimoto, "ABC of Information Retrieval", pp. 92-96, Oct. 20, 1971, Nihon Hoso Kyokai Publication, Ltd.

"Computer Composition", pp. 69 to 71, Oct. 1982, Publishing Dept. of Printing Society.

*Primary Examiner*—Ernest T. Wright, Jr.

*Attorney, Agent, or Firm*—Young & Thompson

[57] ABSTRACT

The invention relates to a composition device for texts in Arabic letters which comprises a keyboard having several keys each corresponding to only one basic letter in all of its shapes, and an electronic device having a memory retaining the codes corresponding to all the shapes of each of the basic letters. A working memory retains the characteristics of the keys depressed immediately before and after the considered key, and a logic determines according to the characteristics memorized in the working memory, the code corresponding to the appropriate shape of the basic letter.

5 Claims, 7 Drawing Figures

FIG.5
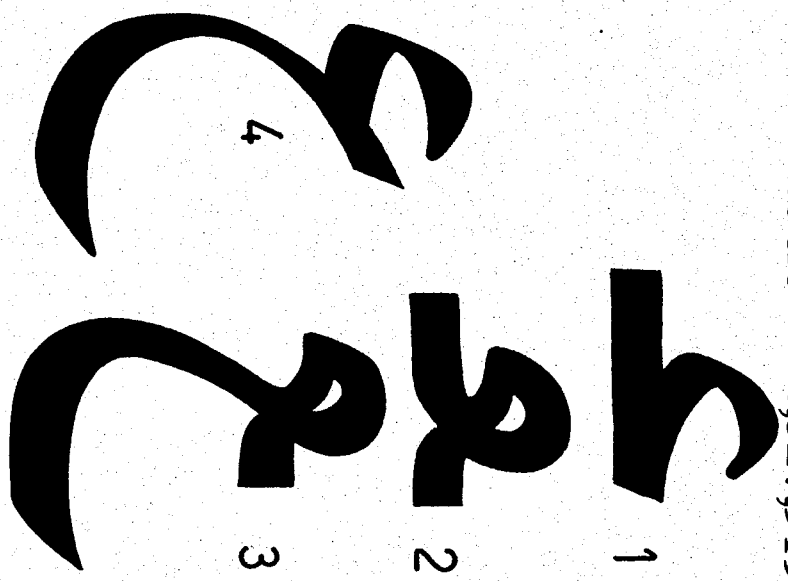
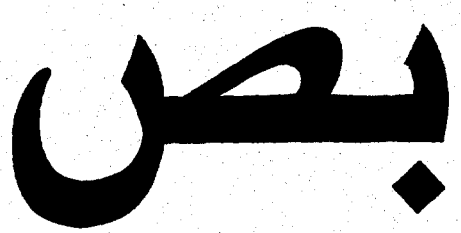
FIG.6a
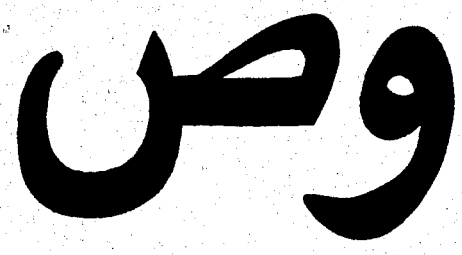
FIG.6b

METHOD FOR THE COMPOSITION OF TEXTS IN ARABIC LETTERS AND COMPOSITION DEVICE

BACKGROUND OF THE INVENTION

This application is a continuation of application Ser. No. 490,205 filed on May 2, 1983, now abandoned, which was a continuation of application Ser. No. 389,896 filed June 18, 1982, now abandoned, which was a continuation of application Ser. No. 199,300 filed Oct. 21, 1980, now abandoned, which was a continuation of application Ser. No. 3,949 filed Jan. 16, 1979, now abandoned.

The invention relates to a machine and a method for the composition of texts in Arabic letters which enable saving time and a greater facility of use.

The writing in Arabic letters has different shapes for certain letters, so-called basic letters, according to characteristics of the preceeding and following signs. In fact, a letter is not written in the same fashion if it is independent, located at the beginning or at the end of a word or further if it is linked to the preceeding letter.

Under these conditions, the existing keyboards must have for each letter several shapes. In the example shown, the different shapes of the basic letters "aïn" appear on keys 8, 19 and 39 of the keyboard shown in FIG. 1. This leads, to maintain the number of keys to an acceptable value, to using the same key for two shapes which may correspond to different basic letters and necessitates the use of a special key to select the printing of the desired shape. This leads to complicated manipulations causing frequent typing errors.

The operator must in fact first select the key on which appears the desired shape of a given basic letter and then select this shape from the other sign appearing on the same key by means of a special key 35 or 46.

SUMMARY OF THE INVENTION

The present composition method tends to remedy these drawbacks by the fact that at least certain basic letters which can have several shapes each correspond to only one key of the keyboard and that when using the key one determines the shape of the basic letter to be used according to characteristics of the keys used just after, or just before and after the key.

The invention has further for its object a composition device for texts in Arabic letters characterized by the fact that it comprises a keyboard having several keys each corresponding to only one basic letter in all of its shapes, by the fact that it comprises an electronic device having a memory retaining the codes corresponding to all of the shapes of each basic letter and a working memory retaining the characteristics of the keys depressed immediately before and after the considered key, and by the fact that a logic determines, according to the characteristics memorized in the working memory, the code corresponding to the appropriate shape of the basic letter.

BRIEF DESCRIPTION OF THE FIGURES

The attached drawing shows schematically and by way of example one embodiment of the device according to the invention.

FIG. 5 shows the four shapes of the basic letter "aïn".

FIG. 6*a* is an example of a letter linked to the following letter.

FIG. 6*b* is an example of a letter which is separated from the following letter.

DETAILED DESCRIPTION

According to the invention, each basic letter corresponds to only one key of the keyboard. For the basic letter having several shapes in the composition of texts, only one shape, for example the primary shape, appears on the key corresponding to the basic letter.

Figure 1:
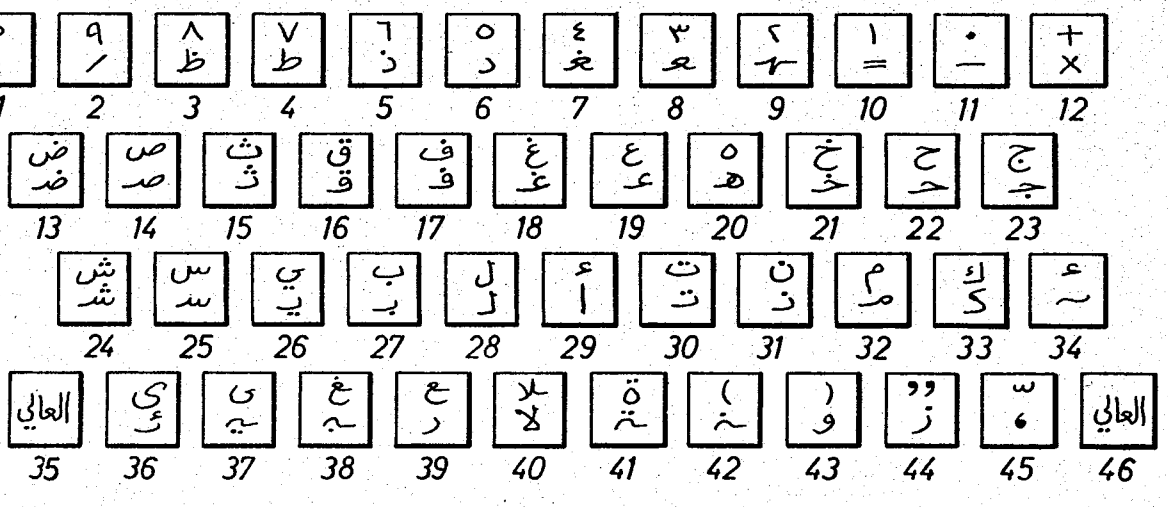
FIG.1 PRIOR ART
FIG. 1 shows a conventional typewriter keyboard.

To facilitate the use of the keyboard, the key corresponding to a given basic letter is located at the same location of the keyboard as the key corresponding to the first shape of this letter in a conventional keyboard having keys 1–46 as shown in FIG. 1.

When depressing a key corresponding to a basic letter, the selection of the appropriate shape of this basic letter is made according to the keys depressed before, or before and after, the considered key.

The selected shape of the basic letter depends on the fact that the key depressed afterwards corresponds either to a letter (not N) or to a sign or function which is not a letter (N). This shape may also depend on the fact that the key depressed before corresponds either to a linked letter (L) or to another sign, letter or function which is not a linked letter (not L).

Figure 2:
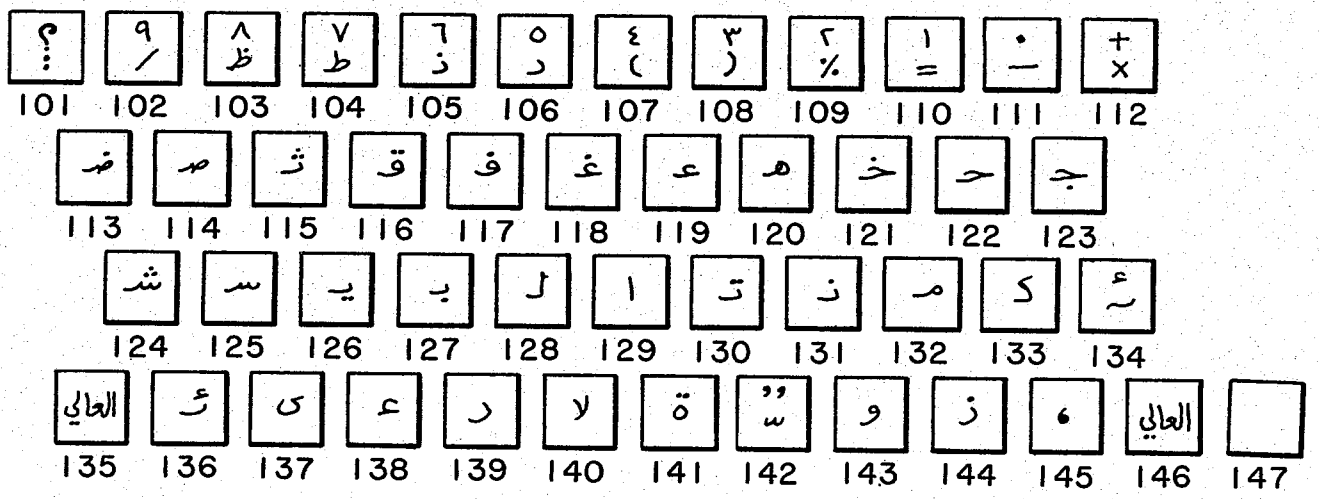
FIG. 2 shows a typewriter keyboard according to the invention.

In the case of a typewriter keyboard according to the invention and shown in FIG. 2, the shape of certain basic letters is determined by the two following keys. This case is present for the basic letters appearing on keys 115, 126, 127, 130, 131, and 136 when the first key used afterward is one of the keys 126 or 136 or by the characteristics of the first following keys when the key is one of the keys 137, 139 or 144 (FIG. 2).

The keys of the keyboard shown in FIG. 2 may be devided up into three categories according to their characteristics. These three categories are:

1. The one of the linked letters L (see FIG. 6*a*)

These letters are the ones which are linked to the following letter in writing.

In the keyboard shown in FIG. 2 these letters correspond to keys 103, 104; 113 to 128; 130 to 133 and 136.

2. The independent (or unlinked) letters D (see FIG. 6*b*).

These independent letters are the ones which are not linked to the following letter in writing. They correspond in the keyboard shown in FIG. 2 to the keys 105, 106, 129, 137, 139, 140, 141, 143, and 144.

3. The keys which do not correspond to a letter N.

This category of keys includes the one corresponding to the signs which are the following keys of the keyboard of FIG. 2 in letters and figures positions 101, 102, 107, 108, 109, 110, 111, 112, 134, 142 and in figures positions 103, 104, 105, 106 as well as the two keys 138 and 145.

Furthermore this category of keys includes all the keys such as keys 135 and 146 corresponding to functions of the machine such as advance paper, carriage movement, etc.

The following table shows the selection of one of the four shapes of the basic letter "aïn" (see FIG. 5) according to the characteristics of the preceeding and following keys used.

| Preceeding key | Following key | Selected shape (see FIG. 5) |
|---|---|---|
| not L D | D not N | 1 |
| D | L | 1 |
| N | D | 1 |
| N | L | 1 |
| L L | D not N | 2 |
| L | L | 2 |
| L | N | 3 |
| not L D | N N | 4 |
| N | N | 4 |

For each basic letter having several shapes, the electronic part of the keyboard comprises a logic similar to the one given by way of example for the letter "aīn" selecting the desired shape as a function of the key depressed after, or before and after, the one corresponding to the desired key.

The codes which are created by the described keyboard can be used, possibly after decoding, to control any kind of printing and/or video machines such as a typewriter, a composing machine, a telex, etc.

The device used for the realization of this method of composition comprises a keyboard having keys corresponding to the different signs to be transmitted or printed. The keyboard can be made as shown for example in FIG. 2 or 3.

In this keyboard the basic letters which may present several shapes according to their use correspond to only one key. This keyboard controls an electronic device comprised in practice by micro-processors but one example of which is schematically given here in the form of a functional diagram in FIG. 4.

Figure 3:
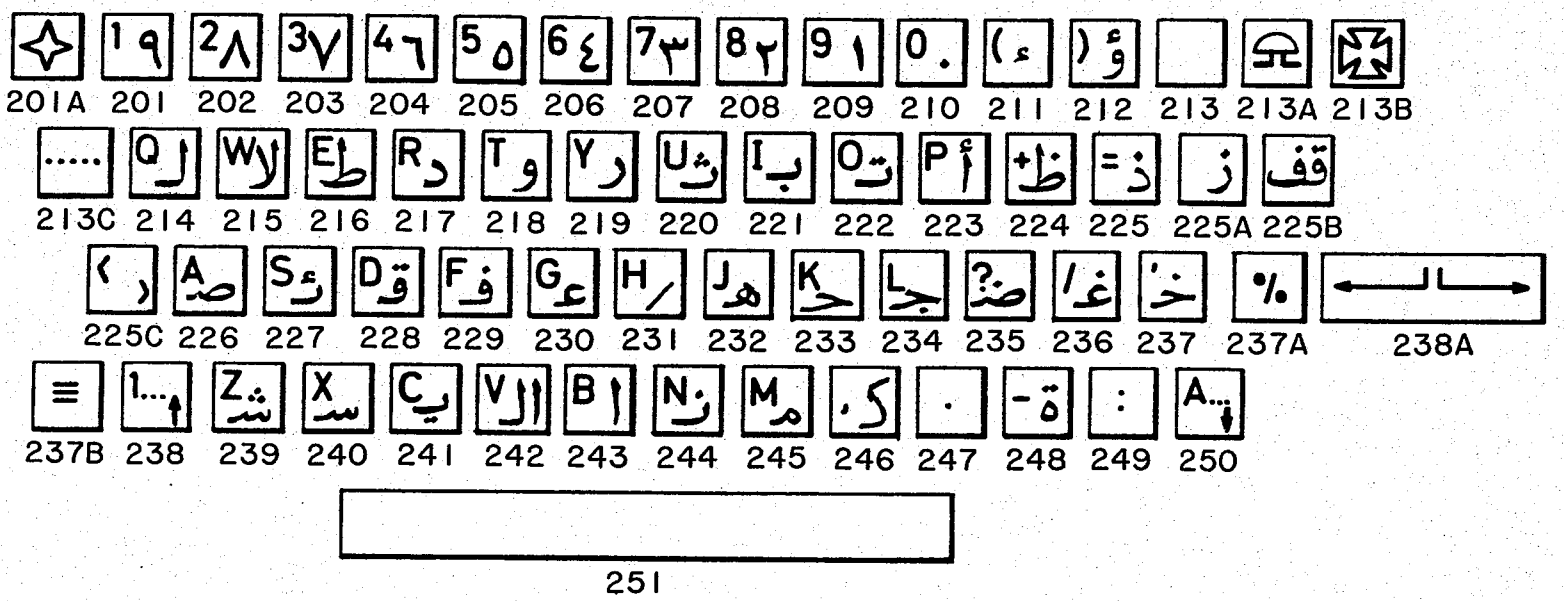
FIG. 3 shows a telex keyboard according to the invention having Arabic as well as Latin letters.
Figure 4:
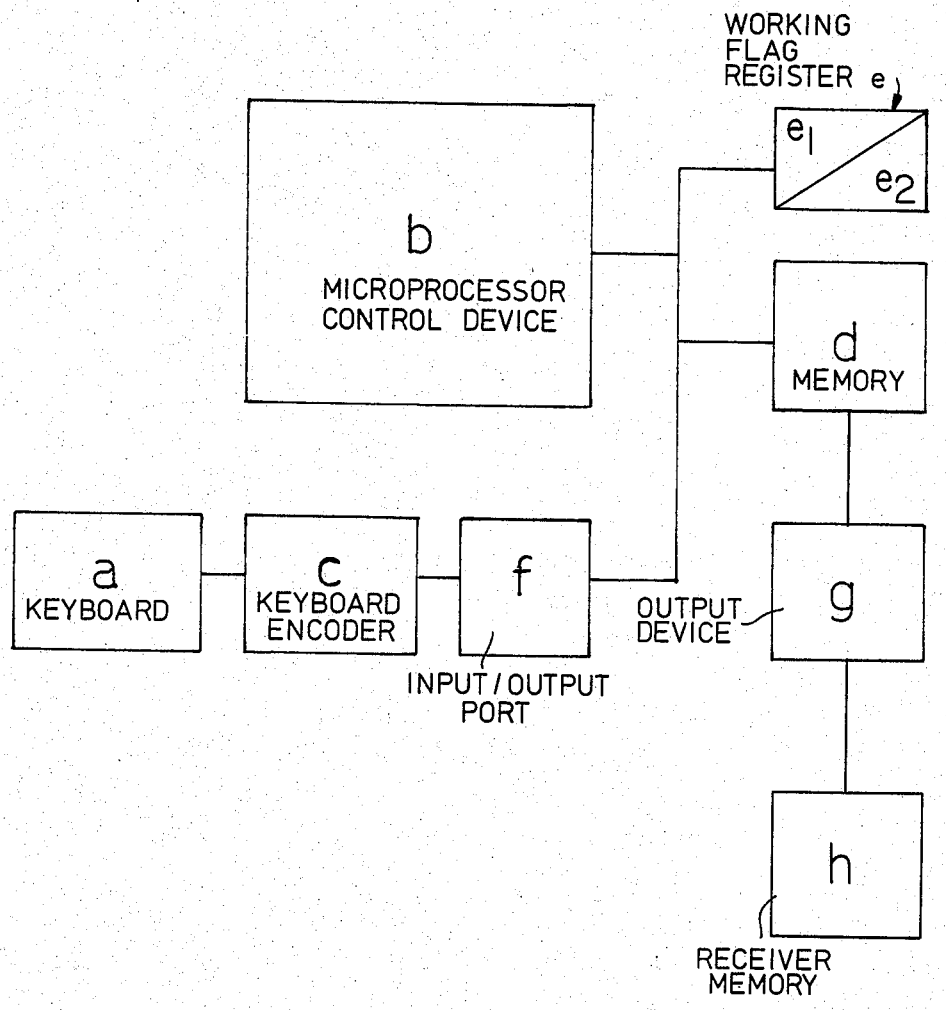
FIG. 4 shows a block diagram of the device.

In FIG. 4, a represents the keyboard shown in FIG. 2 or FIG. 3; b a control device (a conventional microprocessor LSI); c a keyboard encoder (a conventional LSI); d a memory (a conventional read-only memory ROM-LSI); e a working flag register (a conventional read-after memory or conventional random access memory RAM-LSI); f an input/output port (a conventional LSI); and g an output device, i.e., a conventional circuit adapting the output of telex to the transmission network to which it is connected.

The functions of these different elements of the electronic device are as follows:

Control device b

- detects the information of the keyboard code memorized in input/output port f
- refers to the memory d containing the list of the output codes corresponding to all shapes of all letters or signs having to be printed or transmitted
- selects one or more output codes from memory d and transmits them.
- causes the modification of the information memorized in the working flag register e.

The working sequences of the control device b are effectuated according to a program which is also recorded in the memory d.

In the following, the different steps performed by this device are given for the selection of one shape of a basic letter by means of the depression of the one key of the keyboard corresponding to all possible shapes of the basic letter.

One assumes in the following that the working flag register e comprises at the beginning of the sequence of operations the following information:

in its first part $e_1$: the characteristic (L or not L) of a key which has just been depressed before.

in its second part $e_2$: the keyboard code corresponding to the key depressed immediately before, provided that this key corresponds to a letter having more than one shape. If not, this second part $e_2$ is empty.

1. A key of the keyboard a is depressed.
2. The depression of the key causes the formation of a keyboard code corresponding to the key which is obtained by the keyboard encoder c.
3. The keyboard encoder c sends the keyboard code corresponding to the depressed key to the input/output port f which stores it temporarily.
4. The control device b detects the information which is present in port f. In fact the keyboard code of the depressed key indicates whether this key corresponds to a letter having only one shape or to a letter having several shapes.
5. The control device b detects in the first part $e_1$ of the working flag register e whether the second part $e_2$ of this register e stores a keyboard code corresponding to a basic letter having several shapes, the output code of the shape to be printed having not yet been completely selected. One assumes in the present case that the second part $e_2$ of the flag register e is empty.
6. The control device b detects in the first part $e_1$ of the working flag register e whether the last printed letter was a linked (L) letter or an unlinked (not L) letter.
7. The control device b looks in the memory d and selects all of the output codes corresponding to the different shapes which can be printed referring to the depressed key. In the following one assumes that the depressed key is the one corresponding to the letter "aīn" (FIG. 5) which has four possible shapes.
8. Depending on the information present in the first part $e_1$ of the working flag register e (L or not L), control device b cancels two of the four output codes of the letter "aīn". In the case where the characteristic of the preceeding key was L (linked letter) the control device b cancels the output codes corresponding to the shapes 1 and 4 of FIG. 5. In the opposite case (unlinked letter not L) the shapes 2 and 3 of FIG. 5 are canceled (see table above).
9. The control device b erases the flag register e and delivers new information to the register e.
   (a). In the first part $e_1$ of the flag register e, it is determined whether the "aīn" letter is linked (L) or not (not L), as well as whether it is definitely selected or not. In this case the selection is not completed.
   (b). In the second part $e_2$ of the flag register e the keyboard code of the letter "aīn" is recorded by transmission from port f to the register e. This second part $e_2$ of the flag register e receives this information only if the keyboard code corresponds to more than one output code and this is the case for the letter "aīn".
10. The next key is depressed and the port f receives and stores temporarily a keyboard code generated by encoder c.
11. The control device b detects the characteristic N or not N of the code stored in the port f.
12. The control device b detects in the first part $e_1$ of the flag register e the presence or the absence of a keyboard code stored in the second part $e_2$ of this register e. In this case there is such a code in this second part $e_2$ of the register e. The control device b also knows that two output codes have already been canceled.

13. In relation to the information obtained during operation step No. 11, the control device b selects in the memory d one of the two remaining output codes. If the keyboard code of the port f is N, the control device b cancels the output codes corresponding to the shape 1 or 2 of FIG. 5, whereas if the keyboard code of the port f is "not N" control device b cancels the output codes corresponding to the shapes 3 or 4 of FIG. 5 (see table above). Taking into account the first selection made at step No. 8 above and this second selection, only one of the four output codes of the letter "ain" is selected.

14. The control device b causes the transmission, through the memory d, of the unique output code selected to the output device g.

In the case where the depressed key corresponds to a basic letter having three different shapes, the same operations as above are effectuated.

If the depressed key corresponds to a basic letter having only two different shapes corresponding either to the beginning or to the end of a word, the control device b knows it from step No. 7 above and step No. 8 is then canceled.

In the case where the depressed key corresponds to a letter or sign having only one shape the selection operations Nos. 8 and 13 are canceled.

Thanks to the characteristic of the following key (N or not N) and possibly of the preceeding key (L or not L) the appropriate shape of a basic letter to be printed is selected, and still there is only one key for all the shapes of this basic letter.

In the case where one uses this method to send messages by telex through the existing connections and exchanges, it is preferable to have a bi-alphabetical keyboard. Such key may correspond according to the working mode to an Arabic character or a Latin character.

To establish a connection or call, the operator uses for calling the receiver the Latin mode. The service signals from the receiver such as busy line, out of order, etc, are automatically printed in the two alphabets and the two languages in a conventional manner. When the connection is established the operator chooses the transmission mode, Latin or Arabic, according to the message to be transmitted.

The receiver has to be able to identify the language of the received codes and commute to the corresponding Latin or Arabic mode.

Therefore, the codes received are stored in a memory (h) of the receiver, the capacity of which is greater than one line. When this memory (h) is full and there was no reception of the "change of line" code in Arabic mode, the machine starts to print the received codes in the Latin mode. Conversely upon the reception of this "change of line" code in Arabic mode, the machine is automatically switched over to the Arabic mode.

In the Arabic writing countries almost all messages are prefaced by the following (BASMALLAH) message taken from the Koran: BISM ILLAH ALROUHMAN AL RAHIM. Any typing error in this preface is considered as a serious error, and therefore, it is important to have the transcription of this sentence produced automatically and error-free. According to the present method, there is a special key 147 on the keyboard (FIG. 2) which permits the automatic printing of this whole sentence.

It is evident that for reasons of convenience or of transmission the electronic part (b, c, d, e, f, g) of the composition device can be coupled either with a printer or with a keyboard.

FIG. 3 shows a telex keyboard having keys 201–251 corresponding with a standard keyboard as well as supplemental function keys 201A, 213A, 213B, 213C, 225A, 225B, 225C, 237A, 237B, and 238A.

While the invention has been described in detail and with reference to specific embodiments thereof, it will be apparent to one skilled in the art that various changes and modifications can be made therein without departing from the spirit and scope thereof.

What I claim is:

1. Apparatus for composing tests in Arabic letters, comprising (a) a keyboard (a) including (1) a plurality of first letter keys each corresponding with a single basic Arabic letter in its various shapes;

(2) a plurality of second keys selectively operable prior to the operation of at least one of said first letter keys to produce linked signals (L) corresponding with a symbol that can occur in various shapes in accordance with context and unlinked signals (not L) corresponding with a symbol that can occur in only a single shape independent of context, said linked and unlinked signals being used to delineate a portion of the various shapes of the basic letter corresponding with said at least one first letter key; and (3) a plurality of third keys selectively operable subsequent to the operation of said at least one first letter key to produce letter signals (not N) corresponding with the presence of a letter and other than letter signals (N) corresponding with the absence of a letter, said letter and other than letter signals being used to further delineate said portion of said various shapes; and (b) processing means connected with said keyboard for producing the desired shape of a particular basic letter in accordance with the selected operation of a sequence of said second, first, and third keys, said processing means including (1) memory means (d) for storing a plurality of output codes corresponding with all of the various shapes of each of said basic letters;

(2) working register means (e) for retaining the signals from said plurality of second and third keys; and (3) microprocessor control circuit means (b) connected with said memory means and said working register means for processing said retained signals from said second and third keys to determine the output code from said memory means corresponding with the desired shape of said particular basic letter in accordance with the following table:

| Second Key | Third Key | Selected Shape of Letter |
|---|---|---|
| NOT L | NOT N | 1 |
| L | NOT N | 2 |
| L | N | 3 |
| NOT L | N | 4 |

wherein 1 corresponds with the shape of said particular basic letter at the beginning of a word, 2 corresponds with the shape of said basic letter in the middle of a word, 3 corresponds with the shape of said basic letter at the end of a word, and 4 corresponds with the shape of said basic letter independently.

2. Apparatus as defined in claim 1, wherein said processing means further comprises (4) keyboard encoder means (c) connected with said keyboard for forming a keyboard code in response to the selective operation of each of said keys, respectively;

(5) input/output port means (f) connected between said keyboard encoder means and said working register means for temporarily storing said keyboard codes; and (6) an output device connected with said memory means for producing an output corresponding with said determined output code.

3. Apparatus as defined in claim 2, wherein said working register means is operable to store previously output output codes and the keyboard codes from said input/output port means corresponding with said second and third groups of keys.

4. A method of composing tests in Arabic letters, comprising the steps of (a) selectively operating a sequence of second, first, and third keys on a keyboard, the first keys corresponding with a single basic Arabic letter in its various shapes, the second keys producing linked signals (L) corresponding with a symbol that can occur in various shapes in accordance with context and unlinked signals (not L) corresponding with a symbol that can occur in only a single shape independent of context, the third keys producing letters signals (not N) corresponding with the presence of a letter and other than letter signals (N) corresponding with the absence of a letter, the linked, unlinked, letter, and other than letter signals being used to further delineate a portion of the various shapes of the basic letter corresponding with the selectively operated first key;

(b) storing a plurality of output codes corresponding with all of the various shapes of each of the basic letters;

(c) retaining the signals from the selectively operated second and third keys; and (d) processing the retained signals from the second and third keys to determine the output code from the stored codes corresponding with the desired shape of the basic letter in accordance with the following table:

| Second Key | Third Key | Selected Shape of Letter |
|---|---|---|
| NOT L | NOT N | 1 |
| L | NOT N | 2 |
| L | N | 3 |
| NOT L | N | 4 |

wherein 1 corresponds with the shape of said particular basic letter at the beginning of a word, 2 corresponds with the shape of said basic letter in the middle of a word, 3 corresponds with the shape of said basic letter at the end of a word, and 4 corresponds with the shape of said basic letter independently.

5. A method according to claim 4, characterized in that the shape to be selected of the basic letter associated with the keys

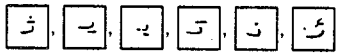

is also determined based on the criterion of the second subsequent key if the first of the following keys is one of the keys

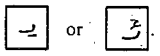

* * * * *